US005275312A

United States Patent [19]

Labruzzo

[11] Patent Number: 5,275,312

[45] Date of Patent: Jan. 4, 1994

[54] ONE-WAY VALVE SUITABLE FOR USE IN PARTICULAR IN A CONTAINER SUPPLYING A LIQUID UNDER PRESSURE

[75] Inventor: Carla Labruzzo, Milan, Italy

[73] Assignee: Sofar SpA, Milan, Italy

[21] Appl. No.: 953,789

[22] Filed: Sep. 30, 1992

[30] Foreign Application Priority Data

Oct. 10, 1991 [IT] Italy ..... MI91 U 000878

[51] Int. Cl.[5] ..... B05B 11/04

[52] U.S. Cl. ..... 222/212; 137/540; 222/496; 222/570

[58] Field of Search ..... 222/212, 213, 494, 495, 222/496, 497, 568, 567, 566, 569, 570, 571; 137/540

[56] References Cited

U.S. PATENT DOCUMENTS

| | | | |
|---|---|---|---|
| 2,957,501 | 10/1960 | Holmes | 222/212 X |
| 3,165,242 | 1/1965 | Jackson . | |
| 3,360,169 | 12/1967 | Susuki et al. | 222/494 X |
| 3,438,554 | 4/1969 | Schwartzman | 222/496 |
| 3,833,154 | 9/1974 | Markowitz | 222/494 X |
| 4,408,702 | 10/1983 | Horvath | 222/496 X |
| 4,785,978 | 11/1988 | Kano et al. | 222/496 X |
| 4,863,070 | 9/1989 | Andris | 222/212 X |

FOREIGN PATENT DOCUMENTS

| | | | |
|---|---|---|---|
| 644986 | 7/1962 | Canada | 222/496 |
| 2234965 | 2/1991 | United Kingdom | 222/212 |

*Primary Examiner*—Kevin P. Shaver
*Attorney, Agent, or Firm*—Wenderoth, Lind & Ponack

[57] ABSTRACT

A one-way valve for a container supplying a liquid under pressure when the container is compressed is designed to be inserted between an outlet of the container and the end of a supply nozzle connected to the container. The valve includes a hollow body inserted partially into the outlet of the container. A base of the hollow body, which is engaged by the end of the nozzle, is open, while the other base of the body has an essentially central hole through which the liquid passes. The hollow body accommodates internally an obturator member essentially including a shaped stopper connected, via elastically deformable lugs, to a support element. The support element has a longitudinal passage of a cross-sectional area greater than that of a cavity formed in the stopper. The lugs are designed to keep the stopper within the hole of the hollow body when the container is not compressed and to allow it to be moved out of the hole when the container is compressed in order to supply the liquid.

15 Claims, 2 Drawing Sheets

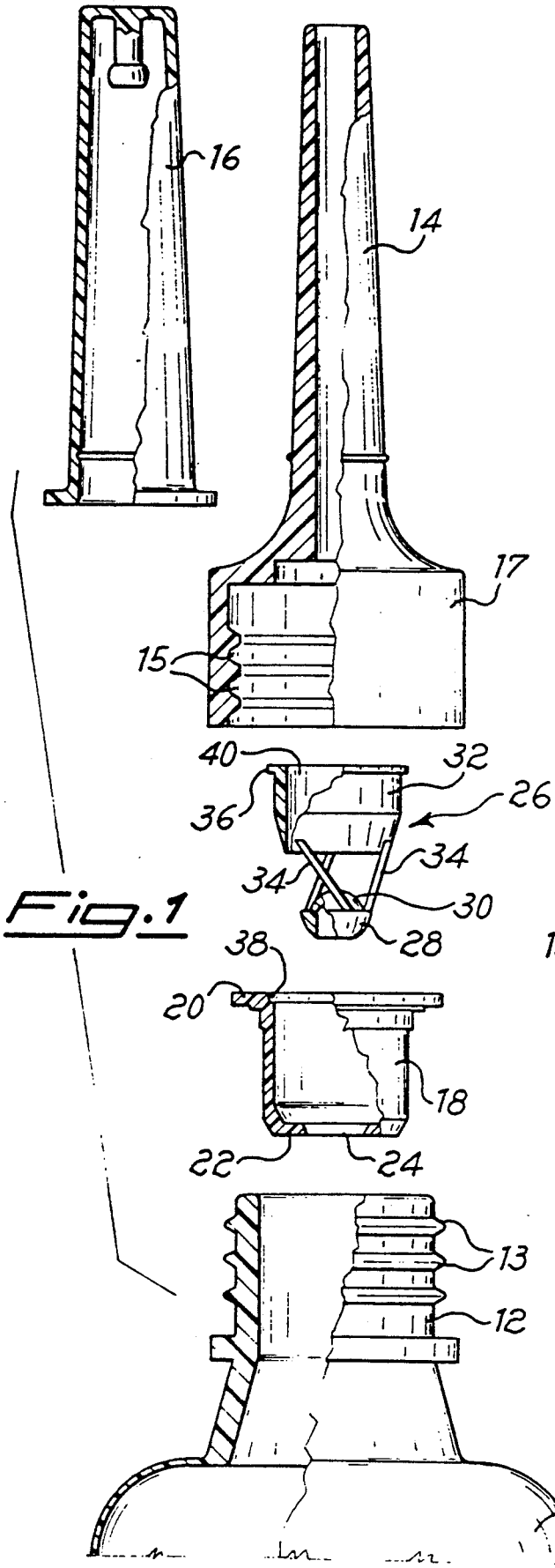
Fig. 1
Fig. 2
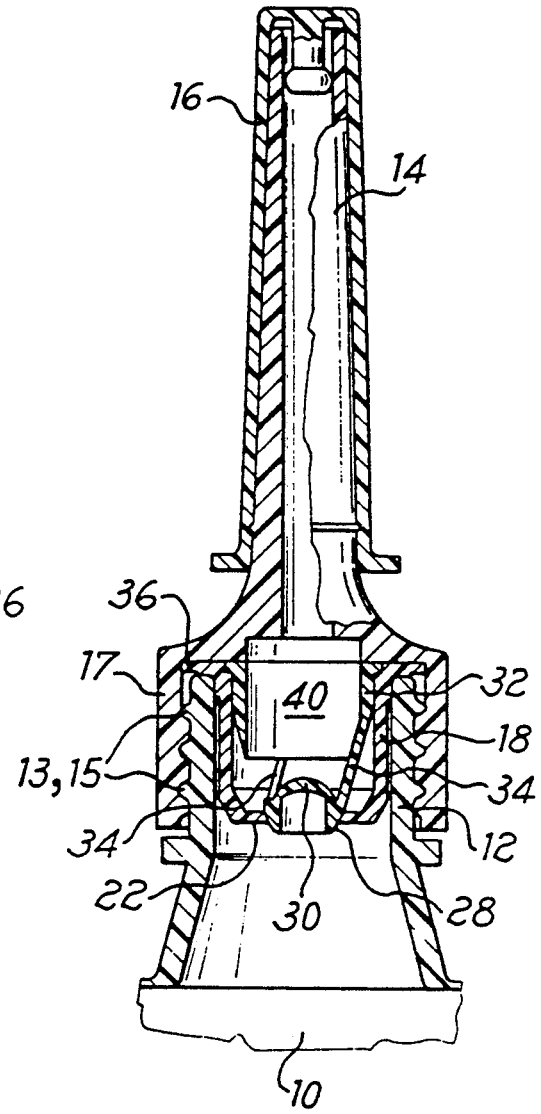

ONE-WAY VALVE SUITABLE FOR USE IN PARTICULAR IN A CONTAINER SUPPLYING A LIQUID UNDER PRESSURE

BACKGROUND OF THE INVENTION

The present invention relates to a valve for use in flexible bottles or containers, the contents of which are to be supplied by means of manual pressure, and having the dual function of:

a) moderating the speed of flow;

b) preventing backflow.

An area in which the valve in question finds widespread use is, for example, the pharmaceutical sector where it is extremely important that a container used to administer liquid for irrigation or medical purposes should exclusively allow the liquid to flow out from the container and prevent it from flowing back into the container for obvious hygiene/sanitary reasons. The containers in question are therefore provided with a unidirectional valve which has the function of performing the above task.

A typical example of a container where it is essential that the aforementioned valve be provided is a rubber syringe used for intestinal enemas or irrigations. In this area of use, it is necessary to moderate the force of flow of the liquid supplied. Otherwise, local pain, cramps and a tearing of the mucous tissue could result.

Implicit reference is made in the present description to this type of container even though it, as well as the abovementioned technical field, is to be regarded purely as examples which are not restrictive.

Containers of the type in question are known and it is also known that they are generally of the disposable type.

The abovementioned containers are provided, internally at the end of the supply nozzle which is connected to the actual container, with a unidirectional valve which essentially consists of thin small disc, generally made of rubber and with a thickness of about 1 mm, which has formed in it a substantially diametral incision. Edges of the disc defining the incision move apart under the effect of the pressure of the liquid inside the container, which pressure is generated by the compressive action exerted on the container made of deformable material. The liquid is therefore able to flow out from the container and the supply stops each time compression of the container is interrupted.

The known valves of this type have significant drawbacks which are linked mainly to the fact that the disc is an extremely delicate component and this negative characteristic must be taken into account both with regard to its manufacture and to the difficulties which are encountered when carrying out the preliminary treatment which the disc must undergo before being fitted on the container, such as washing and sterilization for example.

A further drawback arises from the fact that the disc must have extremely precise dimensions so as to ensure a perfect seal in particular along its edge in order to prevent the undesired seepage of liquid between the latter and the cap for closing the container. Ensuring a uniform thickness of the rubber sheet from which these discs are made, which should remain around one millimeter, represents an unresolved problem. This has meant that it has been necessary to use discs with thicknesses varying from 0.8 to 1.5 mm, thus frequently resulting in a poor sealing action of the closing caps inside which the discs are fitted.

Another significant drawback lies in the fact that fitting the disc requires long and costly manual operations, not to mention the additional operational difficulties of ensuring conditions of absolute hygiene for the manual operations.

SUMMARY OF THE INVENTION

An object of the present invention is to provide a one-way valve for use in particular in a container supplying a liquid by means of manual pressure, which is capable of overcoming all the drawbacks arising from the use of rubber discs and the use of components of conventional valves having imprecise dimensions.

This object of the present invention is achieved by providing a valve of the type in question which has precise dimensional uniformity as well as structural characteristics and a strength such that it may be easily assembled before being fitted, with no costly problems of a technical and hygienic nature.

Another object of the present invention is to provide a valve which has an extremely simple structure and may therefore be manufactured in considerable quantities and at limited cost. It will become clear below that this valve may be fabricated means of simple injection-moulding.

A further object of the invention is to provide a valve which may be fitted without manual operations and hence in a completely automatic manner, thereby achieving a high level of productivity and eliminating the problems of poor hygiene during assembly.

The one-way valve for a container supplying a liquid under pressure by means of manual compression of the container, and designed to be inserted between the outlet mouth of the container and the end of the supply nozzle connected thereto, is characterized in that it comprises a hollow body inserted partially into the outlet mouth of the container, the hollow body having a first base engaging the end of the nozzle and a second base having an essentially central hole through which the liquid passes, the hollow body accommodating internally an obturator member essentially consisting of a shaped stopper connected, by means of elastically deformable lugs, to a support element inserted inside the hollow body and having a longitudinal passage with a cross section greater than that of a cavity formed in the stopper. The lugs are designed to keep the stopper in the hole of the hollow body when the container is not compressed and to allow it to be moved out of the hole when the container is compressed in order to supply the liquid.

BRIEF DESCRIPTION OF THE DRAWINGS

The characteristic features as well as the advantages of the valve according to the present invention will become more clear from the following detailed description of a non-limiting example of an embodiment thereof, a description of which will be made with reference to the accompanying figures, in which:

FIG. 1 is an exploded one-way view of the valve of the present invention with the container partly shown;

FIG. 2 is a side view, partially in section, of the valve in the closed or rest condition;

DETAILED DESCRIPTION OF THE PREFERRED EMBODIMENTS

Figure 3:
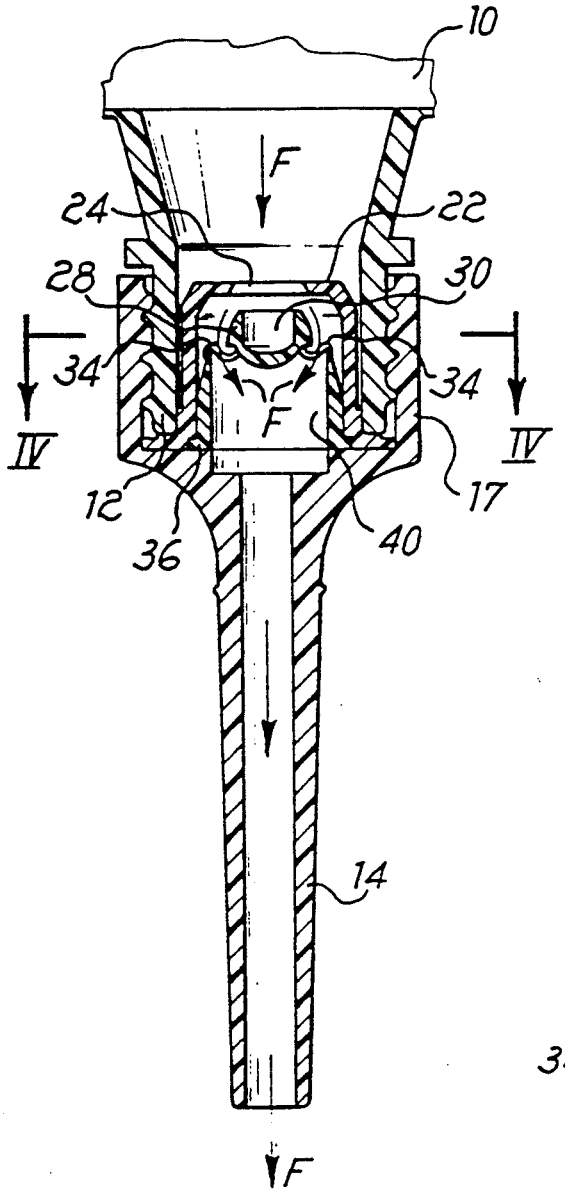
FIG. 3 is a longitudinal sectional view of the valve in the open or working condition.

With reference to the abovementioned figures, the valve according to the present invention applied, purely by way of example, to a container for intestinal enemas or irrigations will now be described, the valve being capable for use with other types of containers without any modification.

Reference numeral 10 denotes a container for a liquid, for example of a medicinal nature, made of deformable plastic material and therefore suitable for supplying the liquid under pressure by means of compression of the container.

A supply nozzle 14, onto which a protective cap 16 is fitted, is fixed to the outlet mouth 12 of the container 10. The securing of the nozzle 14 to the outlet mouth 12 is effected by means of snap engagement and for this purpose the outlet mouth 12 is provided with external peripheral ribs 13 designed to be received in corresponding internal recesses 15 provided in the end 17 of the nozzle 14 which is fitted to the outlet mouth 12. In particular, it will be noted that the actual nozzle 14 and its end 17 are made as a single piece.

A cylindrical hollow body 18 is inserted into the abovementioned outlet mouth 12, the base of which body directed towards the nozzle 14 is open and has an external peripheral edge 20 by which the hollow body 18 rests on the edge of said outlet mouth 12 without projecting therefrom. When the nozzle 14 is fitted to the container 10, it engages the edge 20. This engagement also produces a sealing effect which prevents liquid from passing outside the hollow body 18, allowing the liquid to pass only inside it, as will become more clear below.

The other base 22 of the hollow body 18 is provided with an essentially central hole 24 through which, once the valve is open, the liquid flows from the container 10 to the nozzle 14.

The hollow body 18 accommodates internally an obturator member, denoted in its entirety by the reference number 26, which comprises a shaped stopper 28 adapted to fit in the hole 24 as illustrated in FIG. 2, for closing the valve, and to disengage from the base 22, for opening of the valve, as will be explained below.

As can be seen in particular in FIGS. 1 to 3, the hole 24 is flared with a frusto-conical cross section diverging in the direction of the stopper 28, the latter having a generally cylindrical sidewall correspondingly tapered in the direction of the hole 24 so as to ensure at all times correct engagement of the stopper 28 with the base 22 and proper sealing of the valve in the closed condition.

Again referring to FIGS. 1 to 3 it can be seen that the stopper 28 is concave and its closed base 30, located opposite the nozzle 14, is curved outwards. This arrangement ensures a greater area of contact between the stopper 28 and the liquid under pressure, increasing the thrusting force on the stopper and ensuring that it is moved away from the hole 24 in a more secure and stable manner.

The stopper 28 is connected to its support element 32, described below, by means of a group of three elastically deformable lugs 34, each consisting of a thin plastic fillet, the elasticity of which is such as to allow the stopper 28 to move from the position shown in FIG. 2 (valve closed) to that shown in FIG. 3 (valve open) under the action of the pressurized fluid when the container 10 is compressed and back into the position of FIG. 2 when said compressive action has ceased.

According to one of the characteristic features of the valve according to the invention, the lugs 34 have the same length and are inclined at the same angle with respect to the longitudinal axis of the obturator 26, for example at an angle of 120°, so as to facilitate movement of the stopper 28 and require a smaller thrusting force for the opening of the valve. Moreover, the stopper 28 is located in an essentially central position and its longitudinal axis coincides with that of the hole 24.

As can be further seen from FIGS. 1 and 2, the lugs 34 are all inclined in the same manner and this arrangement ensures that the movement of the stopper 28, during both the opening and closing of the valve, is always rectilinear, this in turn assuring, among other things, that the stopper 28 is correctly received in the hole 24. It must be remembered that the positive effects of the arrangement now described are in addition to the abovementioned advantages arising from the shape of the stopper 28 and the hole 24.

Figure 4:
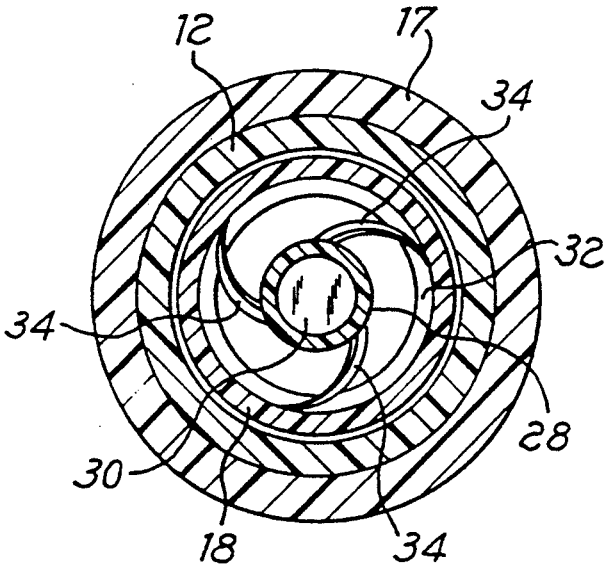
FIG. 4 is a cross-sectional view, on a larger scale, of the valve taken along line IV—IV of FIG. 3.

From FIG. 4, it can also be seen in particular that, in the open condition of the valve, the lugs 34 are deformed in spiral arcs oriented in the same direction and having the same length so as to further ensure the rectilinear movement of the stopper 28.

The support element 32 of the stopper 28 has a generally cylindrical shape and at the top has an external peripheral edge 36 which is inserted into a corresponding seat 38 of the hollow body 18 and, like the latter, is kept in position by the nozzle 14, as can be seen from FIGS. 2 and 3.

The support element 32 has a longitudinal passage 40 with a cross section greater than that of the stopper 28 precisely so as to allow the liquid to flow in the direction of the arrow F in FIG. 3 when the valve is open.

With regard to the materials from which the valve is made, these may consist of polyethylene for the hollow body 18 and ethylene vinyl acetate for the obturator 26.

As a result of this, it is possible to achieve the dual advantage of being able to manufacture the two components by means of simple injection moulding and of being able to assemble them automatically without manual operations.

The valve furthermore is particularly robust as well as being stable and reliable during operation.

Finally it is obvious that variations and/or modification of an equivalent nature may be made to the valve according to the present invention without departing from the scope of the appended claims.

I claim:

1. A one-way valve for use with a container supplying liquid under pressure, said one-way valve comprising: a hollow body having a first base at one axial end thereof, and a second base at the other axial end thereof, said second base having a hole extending through the center thereof; and an obturator accommodated within said hollow body, said obturator having a support element defining a longitudinally extending passage therein, a stopper received in the hole extending through the center of the second base of said hollow body as engaged with said second base, and elastically deformable lugs connecting said stopper to said support element, said stopper having a cavity therein opening to the exterior of the valve in a direction away from said support element, the longitudinal passageway of said support element having a cross-sectional area that is greater than the cross-sectional area of said cavity.

2. A one-way valve as claimed in claim 1, wherein said lugs are inclined with respect to the longitudinal axis of said obturator.

3. A one-way valve as claimed in claim 1, wherein said lugs have the same length and are inclined at the same angle in the same direction with respect to the longitudinal axis of the obturator, said stopper is substantially centered at the longitudinal axis of the obturator, and the longitudinal axis of the obturator substantially coincides with the center of said hole.

4. A one-way valve as claimed in claim 1, wherein said stopper has a base defining the bottom of said cavity, said base of the stopper having an outwardly curved shape.

5. A one-way valve as claimed in claim 1, wherein the hole extending through the second base of said hollow body flares in a direction toward the interior of the hollow body and has a frusto-conical cross section, and said stopper includes a sidewall tapering in a direction away from said support element, the sidewall of said stopper being snugly engaged with the second base of said hollow body within said hole.

6. A one-way valve as claimed in claim 1, wherein said hollow body has a recess therein extending along the inner periphery of said first base so as to define a seat, and said support element has an outer peripheral rim received in said recess such that said obturator is supported by said hollow body at said seat.

7. The combination of a container, a supply nozzle connected to an outlet of the container, and a one-way valve interposed between said outlet of the container and the supply nozzle so as to allow liquid to flow only from said container to the supply nozzle, said one-way valve including a hollow body disposed in the outlet of said container, and an obturator accomodated within said hollow body, said hollow body having a first base at one axial end thereof engaged by an end portion of said supply nozzle so that the hollow body is maintained in position in the outlet of said container, and said hollow body having a second base at the other axial end thereof, said second base having a hole extending through the center thereof, said obturator having a support element defining a longitudinally extending passage therein, a stopper received in the hole extending through the center of the second base of said hollow body as engaged with said second base, and elastically deformable lugs connecting said stopper to said support element, said stopper having an internal cavity opening to the exterior of the valve in a direction away from said support element so as to be in communication with the interior of said container, and the longitudinal passageway of said support element having a cross-sectional area that is greater than the cross-sectional area of said cavity.

8. The combination of a container, a supply nozzle, and a one-way valve as claimed in claim 7, wherein said container has a compressible sidewall such that liquid within the container can be forced under pressure against said stopper by compressing the sidewall of the container.

9. The combination of a container, a supply nozzle, and a one-way valve as claimed in claim 7, wherein said lugs are inclined with respect to the longitudinal axis of said obturator.

10. The combination of a container, a supply nozzle, and a one-way valve as claimed in claim 7, wherein said lugs have the same length and are inclined at the same angle in the same direction with respect to the longitudinal axis of the obturator, said stopper is substantially centered at the longitudinal axis of the obturator, and the longitudinal axis of the obturator substantially coincides with the center of said hole.

11. The combination of a container, a supply nozzle, and a one-way valve as claimed in claim 7, wherein said stopper has a base defining the bottom of said cavity, said base of the stopper having an outwardly curved shape.

12. The combination of a container, a supply nozzle, and a one-way valve as claimed in claim 7, wherein the hole extending through the second base of said hollow body flares in a direction toward the interior of the hollow body and has a frusto-conical cross section, and said stopper includes a sidewall tapering in a direction away from said support element, the sidewall of said stopper being snugly engaged with the second base of said hollow body within said hole.

13. The combination of a container, a supply nozzle, and a one-way valve as claimed in claim 7, wherein the outlet of said container has external ribs, and said nozzle has recesses extending in an inner periphery of said end portion thereof, said recesses being of a shape complimentary to that of said ribs, and said ribs being received in said recesses.

14. The combination of a container, a supply nozzle, and a one-way valve as claimed in claim 7, wherein said supply nozzle is a one-piece member.

15. The combination of a container, a supply nozzle, and a one-way valve as claimed in claim 7, wherein each of said hollow body and said support element is generally cylindrical, the first base of said hollow body engages a peripheral edge of the outlet of said container, said hollow body has a recess therein extending along the inner periphery of said first base so as to define a seat, and said support element has an outer peripheral rim received in said recess such that said obturator is supported by said hollow body at said seat, said support nozzle fixing said hollow body and said obturator in position.

* * * * *